US005355846A

United States Patent [19]

Ozawa

[11] Patent Number: 5,355,846

[45] Date of Patent: Oct. 18, 1994

[54] COOLING DEVICE FOR USE IN ENGINE

[75] Inventor: Yasuo Ozawa, Kariya, Japan

[73] Assignee: Aisin Seiki Kabushiki Kaisha, Aichi, Japan

[21] Appl. No.: 55,018

[22] Filed: Apr. 30, 1993

[51] Int. Cl.[5] ..... F01P 9/02

[52] U.S. Cl. ..... 123/41.21; 165/179

[58] Field of Search ..... 123/41.01, 41.02, 41.2, 123/41.21, 41.23, 41.26, 41.29, 41.3; 165/154, 179

[56] References Cited

U.S. PATENT DOCUMENTS 2,574,573 11/1951 Libby .
3,162,183 12/1964 Gratzmuller ..... 123/41.21
4,893,670 1/1990 Joshi et al. ..... 165/179

FOREIGN PATENT DOCUMENTS 59-180024 10/1984 Japan .
61-48617 10/1986 Japan .
1-155021 6/1989 Japan ..... 123/41.01

*Primary Examiner*—Noah P. Kamen
*Attorney, Agent, or Firm*—Fisher & Associates

[57] ABSTRACT

A cooling device is provided for use in an engine comprising, a first cooling circuit which is filled with first cooling water; a second cooling circuit which includes second cooling water and air; a water jacket of the engine disposed in the first cooling circuit; a heat exchanger including a radiating portion and a cooling portion, the radiating portion being disposed in the first cooling circuit while the cooling portion being disposed in the second cooling circuit; a first pump which is disposed in the first cooling circuit; a condenser which is disposed in the second cooling circuit; and a second pump which is disposed in the second cooling circuit.

20 Claims, 2 Drawing Sheets

COOLING DEVICE FOR USE IN ENGINE

BACKGROUND OF THE INVENTION

1. Field of the Invention

This invention relates to a cooling device for use in an engine.

2. Description of the Related Art

A conventional cooling device for use in an engine having a cylinder block and a cylinder head is, for example, disclosed in the Japanese Patent Laid Open No. 59(1984)-180024. The cooling device of this type comprises a water jacket, a radiator connected to the water jacket through a piping and a water pump which circulates the cooling water. The cooling device is filled with the cooling water. After the cooling water in the water jacket absorbs the heat from the cylinder block and the cylinder head, the heated cooling water is transmitted to the radiator. The heated cooling water is cooled down by means of the radiator and the cooling water is again supplied to the water jacket.

In the above prior art, the cooling device which utilizes an evaporative cooling method is also disclosed. According to the evaporative cooling method the cylinder block and the cylinder head are cooled down by transferring heat which evaporates the cooling water in the water jacket. Thus, the cooling water boils and changes into the steam. The steam is cooled down and changes into the cooling water in a condenser and the cooling water is again supplied to the water jacket by the water a pump. In the evaporative cooling method, a quantity of the cooling water may be small and the size of the radiator may be reduced because the heat of vaporization is larger than the heat which is absorbed by the water in the liquid type system.

However, in the case where the evaporative cooling method is arranged within the conventional engine, the portion of the water jacket exposed to the air is not sufficiently cooled down. Furthermore, the water jacket should be arranged to prevent rust. Thus, the evaporative cooling method requires the reconstruction of the water jacket as disclosed in the Japanese Patent Publication No. 61-48617, for example.

SUMMARY OF THE PRESENT INVENTION

It is an object of the present invention to provide an improved cooling device for use in an engine wherein an evaporative cooling method is applied in the conventional engine without the reconstruction of the water jacket.

It is another object of the present invention to provide an improved cooling device for use in an engine which decreases the driving loss of the engine.

It is a further object of the present invention to provide an improved cooling device for use in an engine which increases the efficiency of the heat exchange.

It is a further object of the present invention to provide an improved cooling device for use in an engine which accurately decreases the temperature of the engine.

It is a further object of the present invention to provide an improved cooling device for use in an engine which is simple in structure and is small in size.

It is a further object of the present invention to provide an improved cooling device for use in an engine which is low in the cost.

To achieve the above-mentioned objects, this invention provides a cooling device for use in an engine comprising, a first cooling circuit which is filled with first cooling water; a second cooling circuit which includes second cooling water and air; a water jacket of the engine disposed in the first cooling circuit; a heat exchanger including a radiating portion and a cooling portion, the radiating portion being disposed in the first cooling circuit while the cooling portion being disposed in the second cooling circuit; a first pump which is disposed in the first cooling circuit; a condenser which is disposed in the second cooling circuit; and a second pump which is disposed in the second cooling circuit.

BRIEF DESCRIPTION OF THE DRAWINGS

The features and advantages of the cooling device for use in an engine according to the present invention will be more clearly appreciated from the following description in conjunction with the accompanying drawings wherein.

DETAILED DESCRIPTION OF THE PREFERRED EMBODIMENTS OF THE INVENTION

Figure 1:
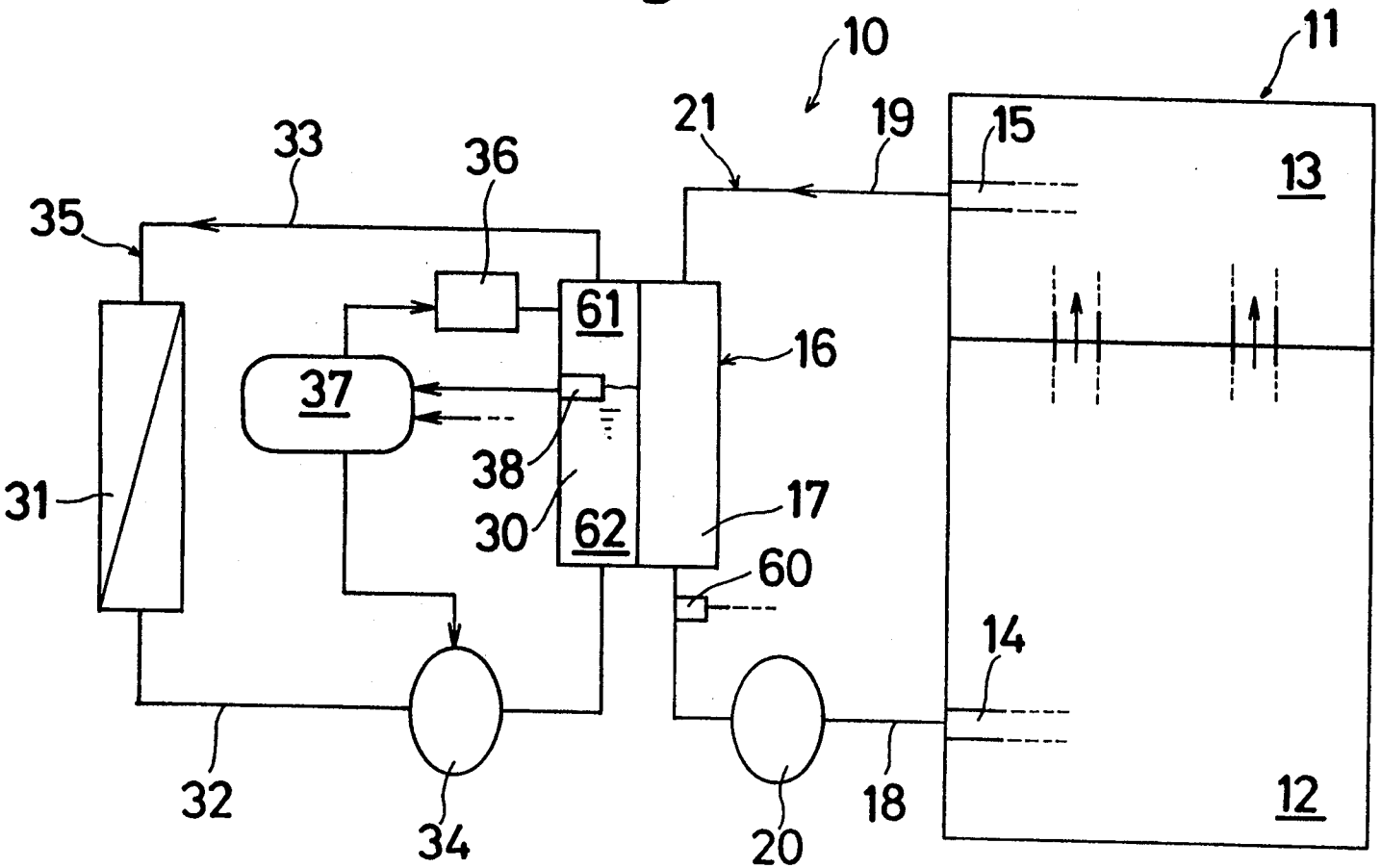
FIG. 1 is a block diagram of a cooling device for use in an engine of the present invention.

Referring to FIG. 1, a cooling device 10 which is used in an engine 11 is illustrated. Engine 11 has a cylinder block 12 and a cylinder head 13 comprising water jackets 14, 15 which are formed in cylinder block 12 and cylinder head 13, respectively. Both of water jackets 14 and 15 are connected to each other at the portion where the cylinder block 12 and cylinder head 13 are connected.

Water jacket 14 is connected to a radiating portion 17 of a heat exchanger 16 through a pipe 18 while water jacket 15 is connected to radiating portion 17 through a pipe 19. A first water pump 20 is disposed in the pipe 18 and is driven by the engine 11. Pump 20 may be driven by a motor such as an electric motor, a hydraulic motor or the like. A first cooling circuit 21 is defined by means of water jackets 14, 15, the radiating portion 17 of the heat exchanger 16, pipes 18, 19 and water pump 20. The first cooling circuit 21 is almost completely filled with first cooling water as a medium of cooling. A thermal sensor 60 is disposed within the pipe 18 and detects the temperature of the first cooling water as well as outputs a signal to a control device 37 which is described later.

A cooling portion 30 of heat exchanger 16 is connected to radiating portion 17 of heat exchanger 16 for providing heat exchange between the radiating portion 17 and cooling portion 30. Cooling portion 30 is connected to a condenser 31 by means of pipes 32 and 33. A second water pump 34 is disposed in piping 32 and is driven by a motor such as an electric motor, a hydraulic motor and the like. A second cooling circuit 35 is defined by cooling portion 30 of heat exchanger 16; condenser 31, piping 32 and 33; and second pump 34. A lower portion 62 of cooling portion 30 is filled with a second cooling water as a medium of cooling and an upper portion 61 of cooling portion 30 is filled with air and thus forms a closed system as illustrated in FIG. 1.

A pressure reduction mechanism 36, for dropping the pressure in the second cooling circuit 5, is disposed in the second cooling circuit 35 and is controlled by the control device 37. A water level sensor 38 is disposed in the cooling portion 30. Control device 37 receives signals which are output by thermal sensor 60 and water level sensor 38 to thereby control, i.e., cause to actuate the second pump 34.

Figure 2:
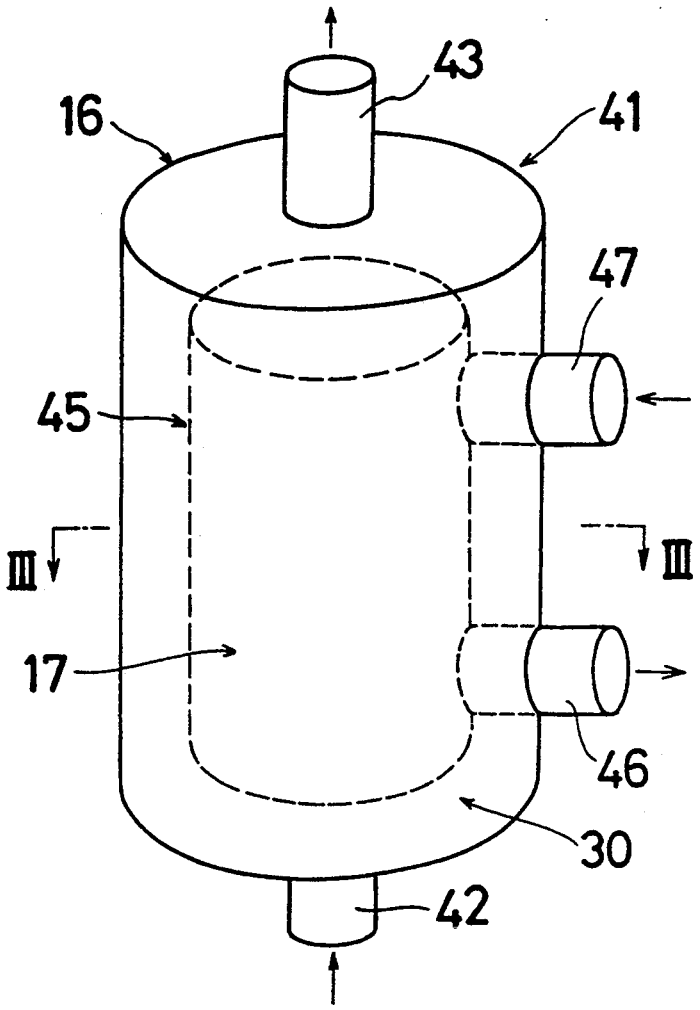
FIG. 2 is a perspective view of a heat exchanger of the present invention.
Figure 3:
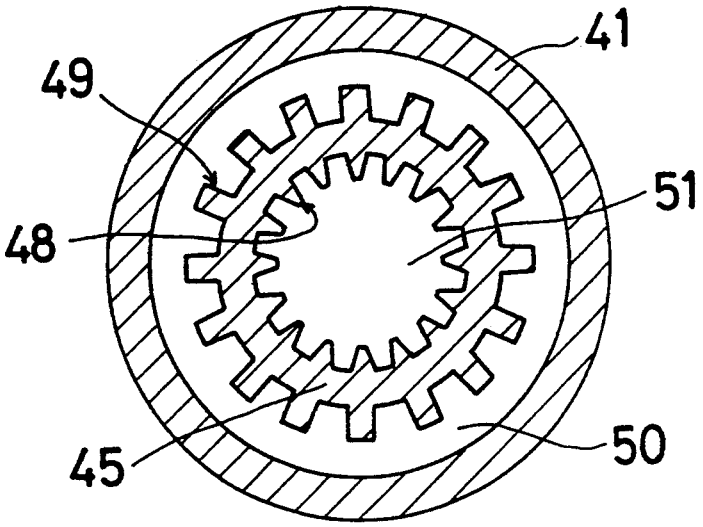
FIG. 3 is a cross-sectional view taken along line III—III of FIG. 2.

Referring to FIGS. 2 and 3, a construction of heat exchanger 16 according to the present invention will be described in detail. Radiating portion 17 is defined by a first housing 45 having an exhaust portion 46 at a lower portion thereof and a supply port 47 at an upper portion thereof. Exhaust port 46 is connected to supply port 47 through a passage 51. Exhaust port 46 is connected to pump 20 and supply port 47 is connected to water jacket 15. Housing 45 is filled with the first cooling water. Housing 45 has fins 48 and 49 which increase the efficiency of heat exchange at circumferential inside and outside locations, respectively.

Cooling portion 30 is defined by a second housing 41 which receives first housing 45 therein. Second housing 41 comprises a supply port 42 at a lower end portion thereof and an exhaust port 43 at an upper end portion thereof. Supply port 42 is connected to exhaust port 43 through a passage 50. Supply port 42 is connected to pump 34 and exhaust port 43 is connected to condenser 31. Housing 45 is supported with respect to housing 41 by a supporting member (not shown).

A preferred method of operation of cooling device 10 will be described hereinafter. When engine 11 drives first pump 20, pump 20 circulates the first cooling water through cooling circuit 21. Thermal sensor 60 detects the temperature in cooling circuit 21 and outputs a signal to control device 37. Second pump 34 and pressure reduction mechanism do not operate under the lower temperature in the first cooling circuit 21. Under these conditions, cooling device 10 circulates only the first cooling water through the cooling circuit 21 without radiating the heat of engine 11. Therefore, engine 11 is warmed up. Although the heat is transmitted from the first cooling circuit 21 to the second cooling circuit 35 via heat exchanger 16, because of the difference between the temperature in the first cooling water in the first cooling circuit 21 and the temperature in the second cooling water in the second cooling circuit 35, this heat transfer is not sufficient to prevent the warming of engine 11.

If the temperature in the first cooling water in the first cooling circuit 21 exceeds a predetermined value, i.e., engine 11 under the warm-up condition goes into normal operational temperature, control device 37 actuates pump 34 and pressure reduction mechanism 36, simultaneously. The heat of the first cooling water in the first cooling circuit 21 is transmitted to the wall of housing 45 through fins 48. Therefore, the temperature of the first cooling water in the first cooling circuit 21 decreases. At this time, pressure reduction mechanism 36 reduces the pressure in the second cooling circuit 35 and the heat of first housing 45 is radiated by vaporizing the second cooling water in lower portion 62 of second housing 41 via fins 49. Therefore, the temperature of housing 45 decreases.

The second cooling water in the second cooling circuit 35 changes in to vapor state and the vapor is transmitted from the upper portion 61 to condenser 31 through pipe 33. The vapor is cooled by a cooling fan and other elements in condenser 31 so as to be condensed into water again. The second cooling water is returned by pump 34 from condenser 31 to a lower portion 62 of second housing 41. The quantity of the evaporation of the second cooling water in the lower portion varies according to the temperature of the cooling water in cooling circuit 21. Therefore, the level of the second cooling water in the lower portion 62 varies. The level of the second cooling water in the lower portion 62 is maintained at a constant level. For example, if the level of the second cooling water detected by level sensor 38 goes below a predetermined value, control device 37 receives the signal which is output by level sensor 38 and actuates second pump 34 so as to increase the volumetric flow rate and thereby increases the supply of the second cooling water in portion 62. If the level of the second cooling water detected by level sensor 38 exceeds the predetermined value, control device 37 actuates pump 34 so as to increase the volumetric flow rate and thereby decrease the supply of cooling water from pump 34, according to the signal which is output by level sensor 38. If the temperature of the first cooling water in cooling circuit 21 exceeds a predetermined value because of the high rotation of engine 11, control device 37 controls pressure reduction mechanism 36 so as to drop the pressure until the signal which is output by the thermal sensor 60 is below the predetermined value. Therefore, the quantity of the second cooling water which evaporates from lower portion 62 increases and the ability to cool down the first cooling water in the first cooling circuit 21 increases.

According to the present invention, the evaporative cooling method is applied to a conventional engine without the reconstruction of the water jacket of the engine.

Furthermore, because both the first cooling water and second cooling water levels are less than the amount of the cooling water in a conventional unit cooling circuit, both the first and second pumps may be smaller. Therefore, the cooling device of this invention may reduce the driving loss of the engine.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A cooling device for use in an engine comprising:

a first cooling circuit which contains a first cooling water;

a second cooling circuit for cooling said engine by an evaporative cooling method, said second cooling circuit containing a second cooling water and air in a closed system;

a water jacket of said engine disposed at one end of said first cooling circuit;

a heat exchanger including a radiating portion and a cooling portion, said radiating portion is disposed in said first cooling circuit and downstream of said water jacket while said cooling portion is disposed in said second cooling circuit;

a first pump which is disposed in said first cooling circuit between said water jacket and said heat exchanger;

a condenser which is disposed in said second cooling circuit and downstream from said cooling portion;

a second pump which is disposed in said second cooling circuit between said condenser and said cooling portion, said second pump for increasing or decreasing the volumetric flow rate of said second cooling water into said cooling portion and thereby controlling the level of said second cooling water in said cooling portion; and control means for controlling the level of said second cooling water in said portion by adjusting the volumetric flow rate of said second pump.

2. A cooling device for use in an engine as recited in claim 1, further comprising:

a pressure reduction means disposed in the second cooling circuit between said cooling portion and said second pump; and control means for controlling said pressure reduction means and said second pump, said control means disposed between said pressure reduction means and said second pump, said control means increasing the pressure reduced by said pressure reduction means and increasing the amount of said second cooling water supplied by said second pump to said cooling portion, by increasing the volumetric flow rate of said second pump, if the temperature of said first cooling water exceeds a predetermined temperature value.

3. A cooling device for use in an engine as recited in claim 2, further comprising a thermal sensor in said first cooling circuit, said thermal sensor for detecting when the temperature of said first cooling water exceeds a predetermined temperature value.

4. A cooling device for use in an engine as recited in claim 1 wherein said control means for controlling the level of said second cooling water in said cooling portion increases the mount of said second cooling water supplied by increasing the volumetric flow rate of said second pump to said cooling portion if the level of said second cooling water in said cooling portion falls below a predetermined level value and decreasing the amount of said second cooling water supplied by decreasing the volumetric flow rate of said second pump to said cooling portion if the level of said second cooling water in said cooling portion exceeds said predetermined level value.

5. A cooling device for use in an engine as recited in claim 4, further comprising a level sensor in said cooling portion, said level sensor for detecting the level of said second cooling water and for indicating said level to said control means.

6. A cooling device for use in an engine as recited in claim 1, wherein said heat exchanger comprises a first housing filled with said first cooling water and including a plurality of fins disposed on both an inside wall and an outside wall of said first housing, wherein said first housing comprises a supply port at an upper portion thereof and an exhaust port at a lower portion thereof; wherein said heat exchanger comprises a second housing including said second cooling water and air and wherein said second housing comprises a supply port at a lower portion thereof and an exhaust port at an upper portion thereof.

7. A cooling device for use in an engine comprising:

a first cooling circuit having a first cooling water therein for cooling said engine by an unevaporative cooling method;

a second cooling circuit having a second cooling water and air therein for cooling said first cooling water by an evaporative cooling method;

a water jacket disposed in said engine and part of said first cooling circuit;

a heat exchanger including a radiating portion and a cooling portion, said radiating portion is disposed in said first cooling circuit and downstream of said water jacket while said cooling portion is disposed in said second cooling circuit;

a first pump which is disposed in said first cooling circuit between said water jacket and said heat exchanger;

a condenser which is disposed in said second cooling circuit and downstream from said cooling portion;

a second pump which is disposed in said second cooling circuit between said condenser and said cooling portion, said second pump for increasing or decreasing the volumetric now rate of said second cooling water into said cooling portion and thereby controlling the level of said second cooling water in said cooling portion; and control means for cooling portion level of said second cooling water in said cooling portion by adjusting the volumetric flow rate of said second pump.

8. A cooling device for use in an engine as recited in claim 7, further comprising:

a pressure reduction means disposed in the second cooling circuit between said cooling portion and said second pump; and control means for controlling said pressure reduction means and said second pump, said control means disposed between said pressure reduction means and said second pump, said control means increasing the pressure reduced by said pressure reduction means and increasing the amount of said second cooling water supplied by said second pump to said cooling portion, by increasing the volumetric flow rate of said second pump, if the temperature of said first cooling water exceeds a predetermined temperature value.

9. A cooling device for use in an engine as recited in claim 8, further comprising a thermal sensor in said first cooling circuit, said thermal sensor for detecting when the temperature of said first cooling water exceeds a predetermined temperature value.

10. A cooling device for use in an engine as recited in claim 7 wherein said control means for controlling the level of said second cooling water in said cooling portion increases the mount of said second cooling water supplied by increasing the volumetric flow rate of said second pump to said cooling portion if the level of said second cooling water in said cooling portion falls below a predetermined level value and decreasing the amount of said second cooling water supplied by decreasing the volumetric flow rate of said second pump to said cooling portion if the level of said second cooling water in said cooling portion exceeds said predetermined level value.

11. A cooling device for use in an engine as recited in claim 10, further comprising a level sensor in said cooling portion, said level sensor for detecting the level of said second cooling water and for indicating said level to said control means.

12. A cooling device for use in an engine as recited in claim 7, wherein said heat exchanger comprises a first housing filled with said first cooling water and including a plurality of fins disposed on both an inside wall and an outside wall of said first housing, wherein said first housing comprises a supply port at an upper portion thereof and an exhaust port at a lower portion thereof;

wherein said heat exchanger comprises a second housing including said second cooling water and air and wherein said second housing comprises a supply port at a lower portion thereof and an exhaust port at an upper portion thereof.

13. A cooling device for use in an engine comprising:

a first cooling circuit which contains a first cooling water;

a second cooling circuit which contains a second cooling water and air in a closed system;

a water jacket of said engine disposed at one end of said first cooling circuit;

a heat exchanger including a radiating portion and a cooling portion, said radiating portion is disposed in said first cooling circuit and downstream of said water jacket while said cooling portion is disposed in said second cooling circuit;

a first pump which is disposed in said first cooling circuit between said water jacket and said heat exchanger;

a condenser which is disposed in said second cooling circuit and downstream from said cooling portion;

a second pump which is disposed in said second cooling circuit between said condenser and said cooling portion, said second pump for increasing or decreasing the volumetric flow rate of said second cooling water into said cooling portion and thereby controlling the level of said second cooling water in said cooling portion;

a pressure reduction means disposed in the second cooling circuit between said cooling portion and said second pump; and control means for controlling said pressure reduction means and said second pump, said control means disposed between said pressure reduction means and said second pump, said control means increasing the pressure reduced by said pressure reduction means and increasing the amount of said second cooling water supplied by said second pump to said cooling portion, by increasing the volumetric flow rate of said second pump, if the temperature of said first cooling water exceeds a predetermined temperature value.

14. A cooling device for use in an engine as recited in claim 13, further comprising a thermal sensor in said first cooling circuit, said thermal sensor for detecting when the temperature of said first cooling water exceeds a predetermined temperature value.

15. A cooling device for use in an engine as recited in claim 13, further comprising control means for controlling the level of said second cooling water in said cooling portion, said control means increasing the amount of said second cooling water supplied by increasing the volumetric flow rate of said second pump to said cooling portion if the level of said second cooling water in said cooling portion falls below a said predetermined level value and decreasing the amount of said second cooling water supplied by decreasing the volumetric flow rate of said second pump to said cooling portion if the level of said second cooling water in said cooling portion exceeds a said predetermined level value.

16. A cooling device for use in an engine as recited in claim 13, further comprising a level sensor in said cooling portion, said level sensor for detecting the level of said second cooling water and for indicating said level to said control means.

17. A cooling device for use in an engine comprising:

a first cooling circuit having a first cooling water therein for cooling said engine by an unevaporative cooling method;

a second cooling circuit having a second cooling water and air therein for cooling said first cooling water by an evaporative cooling method;

a water jacket disposed in said engine and part of said first cooling circuit;

a heat exchanger including a radiating portion and a cooling portion, said radiating portion is disposed in said first cooling circuit and downstream of said water jacket while said cooling portion is disposed in said second cooling circuit;

a first pump which is disposed in said first cooling circuit between said water jacket and said heat exchanger;

a condenser which is disposed in said second cooling circuit and downstream from said cooling portion;

a second pump which is disposed in said second cooling circuit between said condenser and said cooling portion, said second pump for increasing or decreasing the volumetric flow rate of said second cooling water into said cooling portion and thereby controlling the level of said second cooling water in said cooling portion;

a pressure reduction means disposed in the second cooling circuit between said cooling portion and said second pump; and control means for controlling said pressure reduction means and said second pump, said control means disposed between said pressure reduction means and said second pump, said control means increasing the pressure reduced by said pressure reduction means and increasing the amount of said second cooling water supplied by said second pump to said cooling portion, by increasing the volumetric flow rate of said second pump, if the temperature of said first cooling water exceeds a predetermined temperature value.

18. A cooling device for use in an engine as recited in claim 17, further comprising a thermal sensor in said first cooling circuit, said thermal sensor for detecting when the temperature of said first cooling water exceeds a predetermined temperature value.

19. A cooling device for use in an engine as recited in claim 17, further comprising control means for controlling the level of said second cooling water in said cooling portion, said control means increasing the amount of said second cooling water supplied by increasing the volumetric flow rate of said second pump to said cooling portion if the level of said second cooling water in said cooling portion falls below a predetermined level value and decreasing the amount of said second cooling water supplied by decreasing the volumetric flow rate of said second pump to said cooling portion if the level of said second cooling water in said cooling portion exceeds said predetermined level value.

20. A cooling device for use in an engine as recited in claim 19, further comprising a level sensor in said cooling portion, said level sensor for detecting the level of said second cooling water and for indicating said level to said control means.

* * * * *